US005184783A

United States Patent [19]

Hockmeyer et al.

[11] Patent Number: 5,184,783

[45] Date of Patent: Feb. 9, 1993

[54] BASKET MEDIA MILL AND METHOD

[75] Inventors: Herman H. Hockmeyer, Saddle River; John A. Paterson, Point Pleasant, both of N.J.

[73] Assignee: Hockmeyer Equipment Corp., Harrison, N.J.

[21] Appl. No.: 802,137

[22] Filed: Dec. 3, 1991

[51] Int. Cl.[5] ..... B02C 17/00

[52] U.S. Cl. ..... 241/172; 241/74

[58] Field of Search ..... 241/172, 74, 97, 171

[56] References Cited

U.S. PATENT DOCUMENTS

| | | | |
|---|---|---|---|
| 1,951,684 | 3/1934 | Wells | 241/74 |
| 3,332,628 | 7/1967 | Wadham | 241/172 X |
| 3,591,362 | 7/1971 | Benjamin | 241/172 X |
| 4,534,516 | 8/1985 | Hashizume | 241/171 |
| 4,811,909 | 3/1989 | Inoki | 241/172 X |
| 5,080,293 | 1/1992 | Szegvari et al. | 241/172 X |

OTHER PUBLICATIONS

Undated Brochure—"Basket Mill" Asada Iron Works Co., Ltd.

Advertisement—"Turbomill: A New, Highly-Versatile Machine", Eurocoat Mar. 1980.

Article—"Dispersion of Pigments—A Novel Technique", Eurocoat Jul. 8, 1990.

*Primary Examiner*—Douglas D. Watts

*Attorney, Agent, or Firm*—Samuelson & Jacob

[57] ABSTRACT

A media basket mill is used for dispersing a selected constituent into a liquid vehicle to produce a mixture of the constituent and the liquid vehicle and includes a basket containing a media bed of discrete media elements for immersion within a batch of the constituent and the liquid vehicle in a mixing vessel, a first impellar for establishing a first pressure differential adjacent a first end of the basket for moving the mixture along a circuit through the basket, and through the media bed in the basket, when the basket is immersed in the batch in the vessel and a second impeller for establishing a second pressure differential adjacent a second end of the basket for assisting in the movement of the mixture along the circuit into the basket and through the basket, and through the media bed in the basket, to increase the throughput of the mixture through the basket and the media bed in the basket, while deterring escape of media elements from the basket the second end of the basket.

20 Claims, 2 Drawing Sheets

BASKET MEDIA MILL AND METHOD

The present invention relates generally to disperse selected constituents into liquids and pertains, more specifically, to dispersing powdered solids into carrier liquids, such as in apparatus and processes in which a solid constituent is finely divided and dispersed in a liquid vehicle, as in the manufacture of paints, coatings, inks and like products.

For example, paints are manufactured from pigments which are ground into fine particles and mixed or blended with a liquid vehicle. Apparatus currently is available for effecting the required grinding and mixing action by immersing a basket of grinding media into a batch of pigment mixed with a liquid vehicle, held in a vessel, and circulating the mixture of pigment and liquid vehicle through the basket, and through the bed of grinding media contained in the basket, until the desired dispersion of finely divided pigment in liquid vehicle is attained. The basket includes a cylindrical side wall with an upper end having an open entrance, and a bottom wall and may have a capacity within the range of somewhat less than one liter to about four-hundred liters. The walls of the basket are constructed of a grid-like material providing openings, usually in the form of slots, around the periphery of the side wall and in the bottom wall. The media bed preferably is in the form of a mass of discrete media elements, usually individual beads, and the beads have a diameter larger than the transverse dimension of the slots in the walls of the basket in order to contain the beads within the basket. Generally, the media bed occupies eighty to ninety percent of the volume within the basket.

Stirring rods, or like stirring devices, are placed in the basket and are rotated through the media bed, while the basket remains stationary, to agitate the beads as the mixture is circulated through the basket. Circulation of the mixture usually is induced by an impeller located beneath the bottom wall of the basket and rotated about the central axis of the basket. The impeller establishes a pressure differential, axially across the impeller, which draws the mixture through the basket and circulates the mixture within the vessel, around the basket. Thus, circulation is effected along a circuit in the vessel passing around and through the basket. During such circulation, the mixture of pigment and liquid vehicle is subjected to shearing within the media bed, by virtue of contact with the beads of the media bed, which beads are moved by the stirring rods in an up and down oscillatory mode, as well as in a rotational mode. As a result, the pigment is divided into fine particles and the fine particles are dispersed within the liquid vehicle to produce a fully mixed batch. The vessel usually is provided with a cooling jacket in order to prevent overheating of the batch as a result of the rise in temperature induced by the shearing action.

Once the required degree of fineness and dispersion has been reached, the batch is complete and the basket is withdrawn from the vessel. In order to process another batch having different constituents as, for example, a batch of paint of another color, it becomes necessary to clean the apparatus. Cleaning is accomplished most conveniently by immersing the basket within a bath of solvent, usually in the same mixing vessel or in a similar vessel, and rotating the stirring rods and the impeller to circulate the solvent through the media bed while agitating the beads to expose the beads to the solvent. Once cleaned, the basket is ready for immersion into the next batch.

Basket media mills of the type described above currently are sold by Asada Iron Works Co., Ltd. of Osaka, Japan under Model Nos. SS-L, SS-3, SS-10 and SS-20, each having different capacities. A somewhat similar apparatus is sold by Mirodur S.p.A. of Italy, under the designation "TURBOMILL".

It has been found that currently available basket media mills exhibit certain deficiencies. Specifically, it often is necessary to pre-grind the pigment and pre-mix the pigment with the liquid vehicle prior to depositing the mixture in the mixing vessel of the basket media mill. Such a procedure is necessary to assure that only a relatively low viscosity mixture is passed through the basket so as to prevent clogging of the slots in the basket walls. Further, due to relatively slow flow rates, the entire process takes a relatively long time to complete. Attempts at using a larger impeller or a moderately higher speed of rotation in efforts to increase the flow rate have been found to produce excessive movement and agitation of the media bed, resulting in excessive bead oscillation amplitudes, or excessive "chattering" of the beads, with a consequent loss of beads from the media bed through the open entrance at the upper end of the basket. In addition, higher speed operation is deleterious in that wear is increased. Still further, at even higher speeds of operation the media bed tends to move as a mass, thereby losing the effectiveness of the oscillating motion of the beads. In addition to the requirement for excessive time in completing the grinding and mixing process, the cleaning process, when the basket is immersed in solvent, also requires a relatively long time and is not always completely effective.

The present invention provides apparatus and method which avoid many of the problems encountered in the above-described apparatus and exhibits several objects and advantages, some of which may be summarized as follows: First, through the use of a second impeller placed at the upper end of the basket, better circulation of the mixture is attained through the basket; that is, the circulation of the mixture is faster and more uniform and throughput is increased, with a reduced rise in temperature as compared to prior art apparatus. The grinding and mixing operation is more efficient and is effective enough to eliminate the necessity for pre-grinding and pre-mixing in most instances. The dispersion of more finely divided solids is attained in shorter periods of time. In addition, a larger capacity lower impeller can be employed without excessive chattering within the media bed and the escape of beads from the basket. Further, there is a reduced tendency of the grinding media to clog the slots in the walls of the basket. Still further, clean-up is quicker and easier as a result of the increased flow rate, and is more thorough, thereby facilitating a change from one batch to another in manufacturing operations, such as in the manufacture of batches of paint of different colors.

The above objects and advantages, as well as further objects and advantages, are attained by the present invention which may be described briefly as a media basket mill for dispersing a selected constituent into a liquid vehicle to produce a mixture of the constituent and the liquid vehicle within a mixing vessel, the media basket mill comprising: a basket having an interior and a basket wall including an interior surface and an exterior surface, the basket extending axially between a first end and a second end and including an entrance at the second end; a multiplicity of openings in the basket wall, the openings extending from the interior surface to the exterior surface of the basket wall; a media bed in the interior of the basket, the media bed including discrete media elements, the relative dimensions of the media elements and the openings in the basket wall being such that the media bed is retained within the interior of the basket; means for establishing a first pressure differential adjacent the first end of the basket for moving the mixture along a circuit through the basket, and through the media bed in the basket; and means for establishing a second pressure differential adjacent the second end of the basket for assisting in the movement of the mixture along the circuit into the entrance to the basket and through the basket, and through the media bed in the basket, to increase the throughput of the mixture through the basket and the media bed in the basket, while deterring escape of media elements from the basket through the entrance at the second end of the basket. The invention further contemplates the method for dispersing a selected constituent into a liquid vehicle to produce a mixture of the constituent and the liquid vehicle within a mixing vessel, the method comprising: immersing a basket containing a media bed within a batch of the constituent and the liquid vehicle in the mixing vessel, the basket having a basket wall, the basket extending axially between a first end and a second end and including an entrance at the second end and a multiplicity of openings in the basket wall; establishing a first pressure differential adjacent the first end of the basket for moving the mixture along a circuit through the basket, and through the media bed in the basket; and establishing a second pressure differential adjacent the second end of the basket for assisting in the movement of the mixture along the circuit into the entrance to the basket and through the basket, and through the media bed in the basket, to increase the throughput of the mixture through the basket and the media bed in the basket, while deterring escape of media elements from the basket through the entrance at the second end of the basket.

The invention will be understood more fully, while still further objects and advantages will become apparent, in the following detailed description of preferred embodiments of the invention illustrated in the accompanying drawing, in which.

Figure 1:
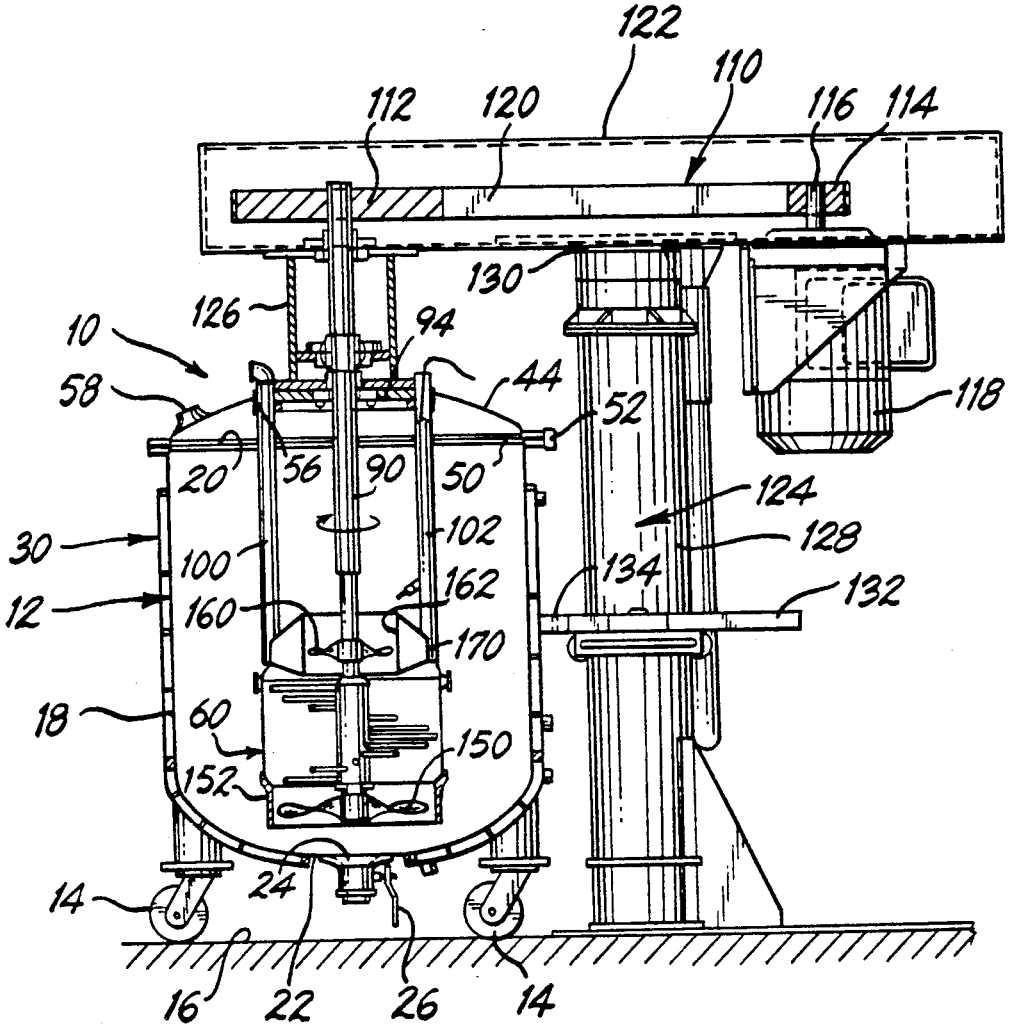
FIG. 1 is a diagrammatic longitudinal cross-sectional view of a basket media mill constructed in accordance with the present invention.
Figure 2:
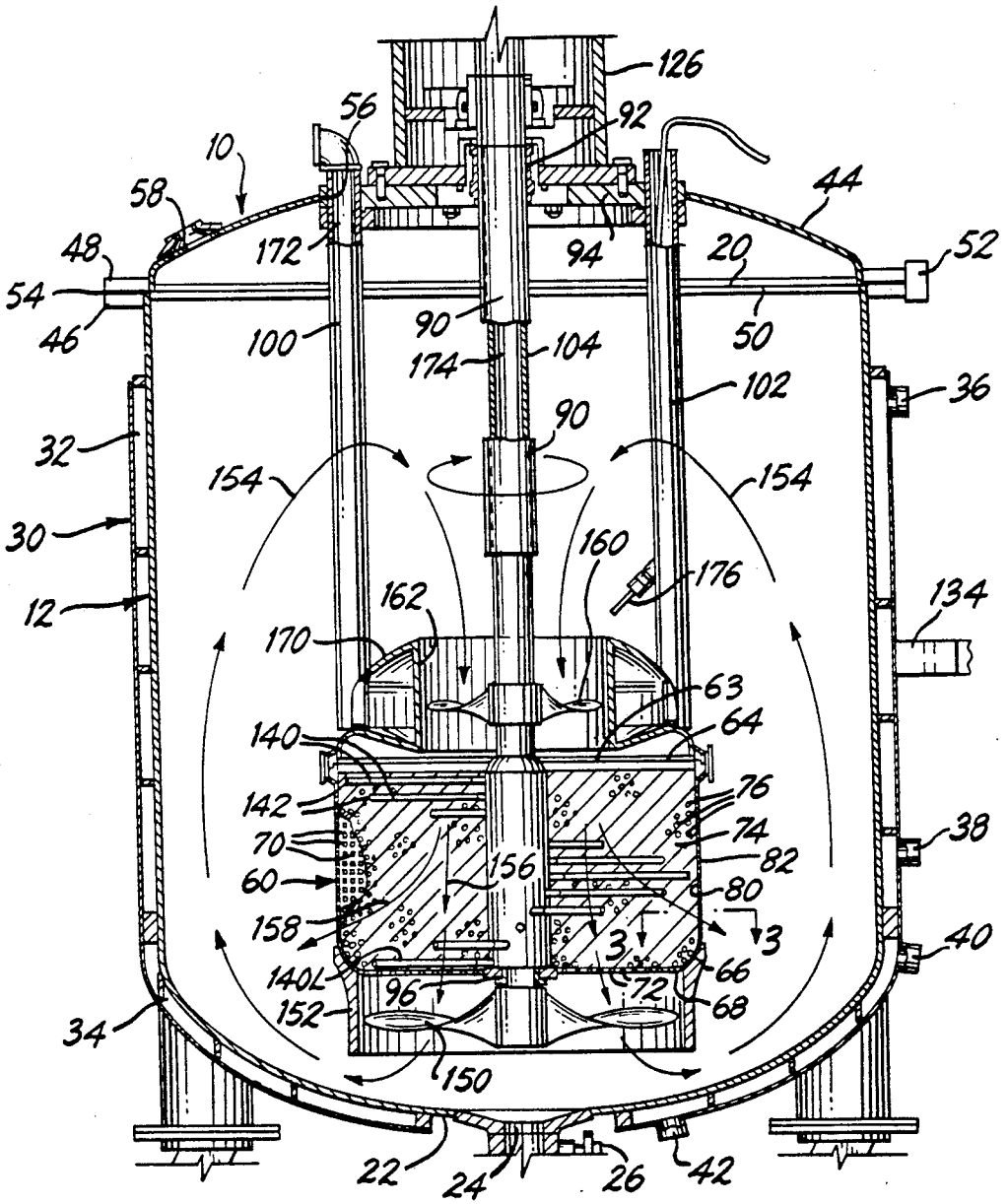
FIG. 2 is an enlarged fragmentary view of a portion of the basket media mill of FIG. 1, showing the mixing vessel, the basket, the stirring rods and the impellers.

Referring now to the drawing, and especially to FIGS. 1 and 2 thereof, a basket media mill constructed in accordance with the present invention is illustrated generally at 10. Basket media mill 10 includes a generally cylindrical mixing vessel 12 supported on casters 14 for movement along a flat surface 16, such as the floor of a manufacturing plant. Vessel 12 includes a wall 18 which extends axially from an upper end 20 to a lower end 22 of the vessel 12, and the vessel 12 is provided at the lower end 22 with an outlet port 24 and a valve 26 through which the contents of the vessel 12 can be drained selectively.

A cooling jacket 30 surrounds most of the side wall 18 and is divided into an upper section 32 and a lower section 34. Upper section 32 includes an inlet 36 for the introduction of a coolant, usually water, to be circulated in the upper section 32 and an outlet 38 for the removal of the circulated coolant. Likewise, the lower section 34 includes an inlet 40 and an outlet 42 for enabling circulation of a coolant through the lower section 34. Cooling jacket 30 is of a conventional construction and is provided in order to cool the materials being processed within the vessel 12, since the grinding and mixing operation tends to heat the contents of the vessel 12.

A removable cover 44 optionally is placed over the upper end 20 of the vessel 12. A first securing flange 46 is provided along periphery of the upper end 20 of the vessel 12 and a second securing flange 48, complementary to the first securing flange 46, is provided along the corresponding periphery of the lower end 50 of the cover 44. When cover 44 is positioned on the upper end of vessel 12, flanges 46 and 48 are secured together by a clamp 52. In addition, a seal 54 may be provided between vessel 12 and cover 44 to prevent the escape of any contents of the vessel 12. Cover 44 is provided with a central opening 56, for purposes which will be described below. It is noted that the inclusion of cover 44 is optional, and the basket media mill 10 may be operated without a cover 44, depending upon the nature of the materials being processed in the vessel 12. When the cover 44 is in place, the materials to be processed in the vessel 12 are delivered through an inlet port 58 in the cover 44. When no cover is employed, the materials to be processed merely are poured into the vessel 12 through the open upper end 20 of the vessel 12.

Figure 3:
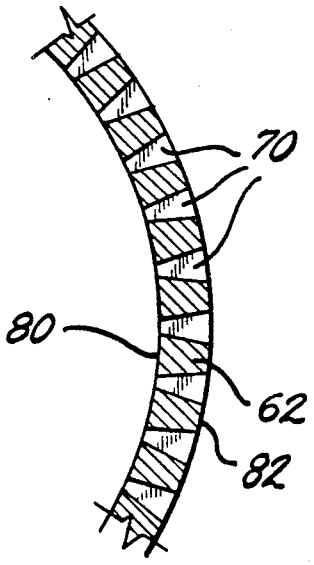
FIG. 3 is a further enlarged cross-sectional view of a portion of the basket, taken along line 3—3 of FIG. 2.

A basket 60 is selectively inserted into the vessel 12 so as to be immersed in the contents of the vessel 12. In the preferred arrangement, the volume of the basket 60 is approximately one-tenth the volume of the vessel 12. For example, the volume of basket 60 can be one gallon, while vessel 12 has a volume of ten gallons. As best seen in FIGS. 2 and 3, as well as in FIG. 1, basket 60 has a generally cylindrical configuration and includes a cylindrical side wall 62 extending from an entrance 63 at upper end 64 to a lower end 66. A bottom wall 68 spans the lower end 66 of the basket 60. The cylindrical side wall 62 of the basket 60 is constructed of a grid-like material having openings shown in the form of axial slots 70 passing radially through the side wall 62. Similar openings in the form of further slots 72 extend axially through the bottom wall 68. A media bed 74 is placed in the basket 60 and preferably is in the form of a mass of discrete media elements illustrated as beads 76. The relative dimensions of the beads 76 and the slots 70 and 72 are such that the media bed 74 is retained in the basket 60. That is, the lateral width of the slots 70 and 72 is no greater than the minimum diameter of the beads 76. In the preferred arrangement, the lateral width of the slots 70 and 72 is approximately one-third the minimum diameter of the beads 76 within the basket 60 so as to facilitate the flow of the contents of vessel 12 through the basket 60 while preventing the escape of beads 76 from the basket 60. As an example, beads 76 can have a diameter within the range of 0.25 mm to 4.0 mm and can be made of any suitable material, such as glass, ceramic, plastic, metal or other high density materials. In addition, greater shearing action is attained in the mixture being processed as the mixture leaves the basket 60 through the slots 70 and 72 by tapering the slots 70 and 72 from a smaller dimension at the inner surface of the basket wall to a larger dimension at the outer surface, as illustrated in FIG. 3 where each slot 70 is seen to have a smaller dimension at the inner surface 80 of the side wall 62 and a larger dimension at the outer surface 82 of the side wall 62. The tapered configuration of the slots 70 and 72 induces a venturi-like action in the material passing through the slots 70 and 72 and effects a higher shear in the mixture as the mixture leaves the basket 60.

A drive shaft 90 extends axially through the basket 60 and is journaled for rotation relative to the basket 60 within an upper bearing 92 carried by a support plate 94 fitted into and sealing the central opening 56 in the cover 44 and a lower bearing 96 in the bottom wall 68 of the basket 60. Columns 100, 102 and 104 (column 104 being partially hidden behind the drive shaft 90 in FIGS. 1 and 2) interconnect the basket 60 with the support plate 94 and mount the basket 60 in a secure, fixed position within the vessel 12 when the support plate 94 is fitted appropriately into the central opening 56 and the cover 44 is clamped in place on the vessel 12. A drive train 110 includes a first pulley 112 affixed to the upper end of the drive shaft 90, a second pulley 114 secured to the output shaft 116 of a drive motor 118, and a drive belt 120 coupling the first and second pulleys 112 and 114 so that operation of the drive motor 118 will rotate the drive shaft 90 about the central axis of the drive shaft 90. Drive motor 118 is carried by an arm 122 of a main frame 124 and the arm 122 is affixed to support plate 94 through a connecting member 126.

Main frame 124 includes a vertical standard 128 which extends between the flat surface 16 and the arm 122. Arm 122 is mounted upon a vertically movable hydraulic lift 130 located within the vertical standard 128. Vessel 12 is held in place relative to the vertical standard 128 by means of a clamp assembly 132 carried by the vertical standard 128 and detachably secured to the vessel 12 at 134. When it is desired to withdraw basket 60 from vessel 12, clamp 52 is released so as to enable separation of the first and second securing flanges 46 and 48 and concomitant release of the cover 44 from the vessel 12. Hydraulic lift 126 is actuated to raise the main frame 122, along with the cover 44 and the support plate 94, and the basket 60 is withdrawn from the vessel 12. In this manner the basket 60 selectively is removed from the vessel 12 and, upon releasing the clamp assembly 132, the vessel 12 can be moved to another station. Should it be desired to clean the basket 60, and the media bed 74 therein, a further vessel, similar to vessel 12, may be placed beneath the basket 60 and the basket 60 may be lowered into a bath of solvent in the further vessel. Operation of the drive motor 118 then will rotate the drive shaft 90 to effect cleaning of the basket 60 and the corresponding component parts, some of which now will be described in greater detail.

As best seen in FIG. 2, a plurality of stirring rods 140 are carried by the drive shaft 90 and extend radially outwardly from the drive shaft 90 into the media bed 74. Preferably, the free ends 142 of the stirring rods 140 are spaced radially from the inner surface 80 of the side wall 62 of the basket 60 by a very small radial distance so as to be closely adjacent to the inner surface 80 of the side wall 62. In this instance, the small radial distance is equal to no more than about one and one-half times the predetermined diameter of the beads 76 of the media bed 74. Likewise, the lowermost stirring rod 140L is spaced axially from the inner surface of the bottom wall 68 of the basket 60 by a very small axial distance so as to be closely adjacent to the inner surface of the bottom wall 68, the preferred small axial distance being equal to no more than about on and one-half times the predetermined diameter of the beads 76. Further, stirring rods 140 are arranged in a spiral array axially along the drive shaft 90. During rotation of the stirring rods 140 with drive shaft 90, the beads 76 are caused to move primarily in a chattering or fluffing manner, that is, with a random up and down motion. By spacing the free ends 142 of stirring rods 140 a very short radial distance from the inner surface 80 of the side wall 62, and by spacing the lowermost stirring rod 140L a very short axial distance from the inner surface of the bottom wall 68, the preferred radial distance and axial distance each being equal to no more than about one and one-half diameters of the beads 76, the beads 76 are forced to move in the aforesaid chattering motion, rather than moving as a mass only in a rotational motion, and the desired shearing or grinding action is enhanced. Additionally, any tendency toward packing of the media bed and clogging of the slots 70 and 72 is reduced. Generally speaking, approximately ninety percent of the mixing accomplished within the basket media mill 10 takes place within the basket 60.

In order to circulate the mixture through the basket 76, means including an impeller 150 is coupled for rotation with the drive shaft 90 at the lower end of the drive shaft 90, below and closely adjacent to the bottom wall 68 of the basket 60. Impeller 150 rotates within a cylindrical shroud 152 which is affixed to and depends from the lower end 66 of the side wall 62 of the basket 60 and has an inner diameter only slightly greater than the overall diameter of the impeller 150. Impeller 150 establishes a pressure differential axially across the impeller 150 which induces circulation of the mixture along a circuit within the vessel 12, as depicted by the arrows 154, 156 and 158 in FIG. 2, the circuit passing through the basket 60, with the mixture exiting the basket 60 through both the side wall 62 and the bottom wall 68.

As an example of the dimensions in a preferred embodiment of the present invention, the inner diameter of vessel 12 is about thirty-six inches, the inner diameter of basket 60 is about eighteen inches and the vertical height of the basket 60 is about nine inches. Impeller 150 has an overall diameter almost as great as the inner diameter of the basket 60 and drive shaft 90 is rotated at a maximum speed of about four-hundred-fifty rpm. Thus, the maximum speed at the tip of impeller 150 is approximately twenty-one-hundred feet per minute, although the speed can be varied depending upon the viscosity of the mixture in the vessel 12.

In the dispersion of pigment into a liquid vehicle, rotation of the drive shaft 90 rotates the impeller 150 which, in turn, causes movement of the mixture of pigment and the liquid vehicle along the circuit depicted by the arrows 154, 156 and 158. The liquid vehicle and pigment thus are caused to flow through the basket 60 and through the media bed 74 in the basket 60. At the same time, the stirring rods 140 cause chattering of the beads 76 of the media bed 74 and rolling of the beads 76 relative to one another. This movement of the beads 76 interacts with the pigment to produce a shearing action between the pigment and the beads 76 and breaks down the pigment into fine particles. The fine particles are dispersed in the liquid vehicle to produce a uniform mixture. Both the present invention and the prior art apparatus outlined above rely upon this basic mechanism. However, problems have arisen in the prior art arrangements.

Specifically, the prior art apparatus is less effective in accepting unmixed pigment and liquid vehicle directly into the mixing vessel and then effectively grinding and dispersing the pigment in the liquid vehicle in an acceptable operating period. As a result, in known arrangements, it has been necessary to pre-grind the pigment and pre-mix the pigment and the liquid vehicle prior to delivering the mixture to the mixing vessel so as to furnish only a relatively low viscosity slurry to the basket and the media bed carried in the basket. Otherwise the basket will tend to "choke" and the mixture will not discharge through the walls of the basket. The throughput through the basket tends to be relatively slow, with a loose assimilation of the beads and the mixture in the basket. Because of a relatively slow flow rate in conventional basket media mills, the entire process requires a relatively long time for completion. In addition to the grinding and mixing process taking a relatively long time, the clean-up process, when the basket is positioned in a vessel containing a solvent, also requires a relatively long time. Attempts at increasing the speed of the impeller even moderately so as to increase the flow rate will cause excessive chattering in the media bed, which could result in the escape of the beads of the media bed through the open upper end of the basket. Greater increases in rotational speed will cause the media bed to rotate as a mass, thereby losing the effectiveness of the oscillating motion of the beads. Also, increased speed leads to increased wear of both the component parts of the mill and the media in the media bed.

The present invention avoids many of the problems encountered in the prior art. Thus, means including a second or upper impeller 160 is coupled to drive shaft 90 at the upper end of basket 60, adjacent the entrance 63 to the basket 60, for rotation with the drive shaft 90. The upper impeller 160 rotates within an upper tubular shroud 162 which closely surrounds the impeller 160. Rotation of the impeller 160 establishes a pressure differential axially across the impeller 160, raising the pressure at the entrance 63 to the basket 60. The pressure differential established by the upper impeller 160 is less than the pressure differential established by the lower impeller 150, and preferably is about one-half the pressure differential established by the lower impeller 150. In this manner, the two impellers 150 and 160 attain a balanced pressure differential axially across the basket 60 for enhanced flow of the mixture through the basket 60, while assisting in the appropriate agitation of the beads 76 in the media bed 74 for optimum grinding and dispersion of the pigment within the liquid vehicle. In the illustrated embodiment, the lower and upper impellers 150 and 160 rotate at the same speed and the upper impeller 160 is provided with an overall diameter smaller than the overall diameter of the lower impeller 150 so as to establish a pressure differential across the upper impeller 160 which is less than the pressure differential established across the lower impeller 150, and usually about one-half the magnitude of the pressure differential established across the lower impeller 150. Preferably, the ratio of the overall diameters of the upper impeller 160 to the lower impeller 150 is 9:16. Thus, for a lower impeller 150 having an overall diameter of approximately eighteen inches, upper impeller 160 would have an overall diameter of approximately ten and one-eighth inches. As a result, circulation through the basket 60 is faster and more uniform, and the grinding and mixing operation is more efficient so that it is not necessary to utilize a pre-grinding and pre-mixing operation. Still further, clean-up, as described above, is easier because of the greater volumetric flow, and is more thorough, so that it becomes relatively easy to change from one batch to another in the operation, as in changing from one color to another in the manufacture of different batches of paint.

The balance attained by the pressure differentials established by the lower impeller 150 and the upper impeller 160, together with the pressure drop axially along the basket 60, assures a constant and uniform flow through the basket 60. In addition, the lower impeller 150 can be made to have a larger volumetric capacity, since the upper impeller 160 prevents unduly large vertical oscillations or excessive chattering of the beads 76, which could cause the escape of beads 76 through the entrance 63 at the upper end of the basket 60. The relative dimensions and relative volumetric capacities of lower impeller 150 and upper impeller 160 are adjusted to provide an appropriate balance of pressure in the mixture flowing through the basket 60.

As a result of the increased volumetric flow made available by the use of the upper impeller 160, the rate of grinding and mixing is increased. It has been observed that the increased volumetric flow rate through the basket 60 tends to reduce the temperature rise within the mixture being processed, as compared with the temperature rise experienced in prior art apparatus, thus reducing the tendency to degrade the material being mixed. As an additional measure, however, in the preferred embodiment, a cooling collar 170 is provided around the outer periphery of the upper shroud 162 at the upper end of the basket 60 to further control the temperature of the mixture being processed. An input coolant passage 172 extends through column 100 and interconnects cooling collar 170 with a supply of coolant (not shown), such as water, and an output coolant passage 174 extends through column 104 to connect the cooling collar 170 with the supply of coolant and complete a coolant circuit. As a result, the mixture flowing past upper impeller 160 is cooled by the cooling collar 170 in order to reduce the temperature of the material being mixed. A temperature probe 176 senses the temperature of the mixture and provides a signal for controlling the flow of coolant from the supply to the cooling collar 170.

Although in the illustrated embodiment the appropriate ratio between the pressure differentials established by the lower impeller 150 and the upper impeller 160 is attained by the choice of impeller diameter, other means are available for attaining the desired ratio. Thus, lower and upper impellers of the same diameter can be employed in connection with a drive system which would drive the upper impeller at a lower speed than the lower impeller. For example, a pair of coaxial drive shafts could be coupled one to each impeller and driven independently at different speeds by independent drive motors. Alternately, the coaxial drive shafts could be coupled by a reduction gear system driven by a single drive motor. In all of the suggested arrangements, the pressure differential established by the upper impeller is less than the pressure differential established by the lower impeller so as to balance the pressure along the basket and through the media bed for optimum throughput of the material being mixed.

It will be seen that the present invention attains the objects and advantages summarized above; namely: The use of a second impeller placed at the upper end of the basket attains better circulation of the mixture through the basket; that is, the circulation of the mixture is faster and more uniform and throughput is increased, with a reduced rise in temperature as compared to prior art apparatus. The grinding and mixing operation is more efficient and is effective enough to eliminate the necessity for pre-grinding and pre-mixing in most instances. The dispersion of more finely divided solids is attained in shorter periods of time. In addition, a larger capacity lower impeller can be employed without excessive chattering within the media bed and the escape of beads from the basket. Further, there is a reduced tendency of the grinding media to clog the slots in the walls of the basket. Still further, clean-up is quicker and easier as a result of the increased flow rate, and is more thorough, thereby facilitating a change from one batch to another in manufacturing operations, such as in the manufacture of batches of paint of different colors.

It is to be understood that the above detailed description of preferred embodiments of the invention is provided by way of example only. Various details of design, construction and procedure may be modified without departing from the true spirit and scope of the invention as set forth in the appended claims.

The embodiments of the invention in which an exclusive property or privilege is claimed are defined as follows:

1. A media basket mill for dispersing a selected constituent into a liquid vehicle to produce a mixture of the constituent and the liquid vehicle within a mixing vessel, the media basket mill comprising:

a basket having an interior and a basket wall including an inner surface and an outer surface, the basket extending axially between a first end and a second end and including an entrance at the second end;

a multiplicity of openings in the basket wall, the openings extending from the inner surface to the outer surface of the basket wall;

a media bed in the interior of the basket, the media bed including discrete media elements, the relative dimensions of the media elements and the openings in the basket wall being such that the media bed is retained within the interior of the basket;

first impeller means for establishing a first pressure differential adjacent the first end of the basket for moving the mixture along a circuit through the basket, and through the media bed in the basket, when the basket is immersed in the mixture in the vessel; and second impeller means for establishing a second pressure differential adjacent the second end of the basket for assisting in the movement of the mixture along the circuit into the entrance to the basket and through the basket, and through the media bed in the basket, to increase the throughput of the mixture through the basket and the media bed in the basket, while deterring escape of media elements from the basket through the entrance at the second end of the basket.

2. The invention of claim 1 wherein the second pressure differential is less than the first pressure differential.

3. The invention of claim 1 wherein:

the first impeller means includes a first impeller having a first overall diameter and being mounted for rotation adjacent the first end of the basket;

the second impeller means includes a second impeller having a second overall diameter and being mounted for rotation adjacent the second end of the basket; and drive means coupled with the first impeller and the second impeller for rotating the first impeller and the second impeller at the same rotational speed;

the second overall diameter being less than the first overall diameter.

4. The invention of claim 3 wherein the ratio of the second overall diameter to the first overall diameter is approximately 9:16.

5. The invention of claim 1 wherein:

the basket is oriented such that the first end is a lower end and the second end is an upper end;

the wall of the basket includes a generally cylindrical side wall extending axially between the first end and the second end of the basket, and a bottom wall spanning the first end;

the openings are located in the side wall and in the bottom wall;

the first impeller means is located at the lower end, adjacent the outer surface of the bottom wall; and the second impeller means is located at the upper end, adjacent the entrance to the basket.

6. The invention of claim 5 wherein:

the basket includes a central axis;

the first impeller means includes a first impeller having a first overall diameter and being mounted for rotation about the central axis adjacent the first end of the basket;

the second impeller means includes a second impeller having a second overall diameter and being mounted for rotation about the central axis adjacent the second end of the basket; and drive means coupled with the first impeller and the second impeller for rotating the first impeller and the second impeller at the same rotational speed.

7. The invention of claim 6 wherein the second overall diameter is less than the first overall diameter.

8. The invention of claim 6 wherein the ratio of the second overall diameter to the first overall diameter is approximately 9:16.

9. The invention of claim 6 including a plurality of stirring rods mounted for rotation about the central axis, the stirring rods extending radially into the media bed from the central axis toward the side wall of the basket and arrayed axially along the central axis in a spiral, the stirring rods each having a free end spaced radially from and located closely adjacent to the inner surface of the side wall.

10. The invention of claim 9 wherein the discrete media elements comprise beads having a predetermined diameter and the radial spacing between the free end of each stirring rod and the inner surface of the side wall is equal to no more than one and one-half times the predetermined diameter of the beads.

11. The invention of claim 9 wherein the plurality of stirring rods include a lowermost stirring rod spaced axially from and located closely adjacent to the inner surface of the bottom wall of the basket.

12. The invention of claim 11 wherein the discrete media elements comprise beads having a predetermined diameter, the radial spacing between the free end of each stirring rod and the inner surface of the side wall is equal to no more than one and one-half times the predetermined diameter of the beads, and the axial spacing between the lowermost stirring rod and the inner surface of the bottom wall is equal to no more than one and one-half times the predetermined diameter of the beads.

13. The invention of claim 6 wherein the second impeller means includes an axially extending tubular shroud placed around the second impeller such that mixture is moved by the second impeller through the shroud and into the entrance to the basket.

14. The invention of claim 13 including cooling means for cooling the mixture moving through the shroud.

15. The invention of claim 14 wherein the cooling means includes a cooling collar, surrounding the shroud.

16. The method for dispersing a selected constituent into a liquid vehicle to produce a mixture of the constituent and the liquid vehicle within a mixing vessel, the method comprising:

immersing a basket containing a media bed within a batch of the constituent and the liquid vehicle in the mixing vessel, the basket having a basket wall, the basket extending axially between a first end and a second end and including an entrance at the second end and a multiplicity of openings in the basket wall;

establishing a first pressure differential adjacent the first end of the basket for moving the mixture along a circuit through the basket, and through the media bed in the basket; and establishing a second pressure differential adjacent the second end of the basket for assisting in the movement of the mixture along the circuit into the entrance to the basket and through the basket, and through the media bed in the basket, to increase the throughput of the mixture through the basket and the media bed in the basket, while deterring escape of media elements from the basket through the entrance at the second end of the basket.

17. The invention of claim 16 wherein the second pressure differential is less than the first pressure differential.

18. The invention of claim 17 wherein the wall of the basket includes a generally cylindrical side wall extending axially between the first end and the second end of the basket, and a bottom wall spanning the first end, and the openings are located in the side wall and in the bottom wall, the invention including orienting the basket such that the first end is a lower end and the second end is an upper end.

19. A media basket mill for dispersing a selected constituent into a liquid vehicle to produce a mixture of the constituent and the liquid vehicle within a mixing vessel, the media basket mill comprising:

a basket having an interior and a basket wall including an inner surface and an outer surface, the basket extending axially between a first end and a second end and including an entrance at the second end;

a multiplicity of openings in the basket wall, the openings extending from the inner surface to the outer surface of the basket wall;

a media bed in the interior of the basket, the media bed including discrete media elements, the relative dimensions of the media elements and the openings in the basket wall being such that the media bed is retained within the interior of the basket;

means for establishing a first pressure differential adjacent the first end of the basket for moving the mixture along a circuit through the basket, and through the media bed in the basket; and means for establishing a second pressure differential adjacent the second end of the basket for assisting in the movement of the mixture along the circuit into the entrance to the basket and through the basket, and through the media bed in the basket, to increase the throughput of the mixture through the basket and the media bed in the basket, while deterring escape of media elements from the basket through the entrance at the second end of the basket.

20. The invention of claim 19 wherein the second pressure differential is less than the first pressure differential.

* * * * *